US006039230A

United States Patent [19]

Yagi et al.

[11] Patent Number: 6,039,230

[45] Date of Patent: Mar. 21, 2000

[54] ROLL STAPLE AND STAPLE CARTRIDGE STORING THE SAME

[75] Inventors: Nobuaki Yagi; Atuyoshi Fujishima, both of Tokyo, Japan

[73] Assignee: Max Co., Ltd., Tokyo, Japan

[21] Appl. No.: 09/195,204

[22] Filed: Nov. 18, 1998

[30] Foreign Application Priority Data

| | | | |
|---|---|---|---|
| Nov. 19, 1997 | [JP] | Japan | 9-318701 |
| Mar. 13, 1998 | [JP] | Japan | 10-082862 |
| Mar. 13, 1998 | [JP] | Japan | 10-082863 |
| Oct. 27, 1998 | [JP] | Japan | 10-306000 |

[51] Int. Cl.[7] ..... B27F 7/21; B25C 5/16

[52] U.S. Cl. ..... 227/120; 227/131; 227/136; 227/76

[58] Field of Search ..... 227/120, 131, 227/135, 136, 76, 7; 206/340

[56] References Cited

U.S. PATENT DOCUMENTS

| | | | |
|---|---|---|---|
| 4,573,625 | 3/1986 | Olesen et al. | 227/120 |
| 4,623,082 | 11/1986 | Kurosawa | 227/131 |
| 4,993,616 | 2/1991 | Yoshie et al. | 227/120 |
| 5,474,222 | 12/1995 | Kanai et al. | 227/131 |
| 5,560,529 | 10/1996 | Udagawa et al. | 227/136 |
| 5,676,299 | 10/1997 | Yoshie et al. | 227/131 |

FOREIGN PATENT DOCUMENTS 9-13627 5/1997 Japan .

*Primary Examiner*—Scott A. Smith
*Attorney, Agent, or Firm*—Morgan, Lewis & Bockius LLP

[57] ABSTRACT

In the left-and-right-direction center of the bottom portion of a staple loading chamber 5, there is formed an opening 6, the left-and-right-direction central portion of the upper surface of a staple guide table 7 is exposed through the opening 6, and on the two left and right sides of the opening 6, there are formed staple guide grooves 9L and 9R which respectively communicate with the staple guide table 7. A belt with a tab portion is bonded to and wound on a roll staple. If the roll staple with the belt is inserted into the staple loading chamber 5, a front lid 2 is closed and the belt is pulled forwardly while holding the tab portion thereof, then the belt comes loose, so that the front portion of the roll staple is guided into the staple guide grooves 9L and 9R and is then fed to a position located in front of the staple guide table 7. If the tab portion of the belt is pulled further, then the belt is peeled off the front portion of the roll staple, which completes the loading of the roll staple.

7 Claims, 15 Drawing Sheets

ROLL STAPLE AND STAPLE CARTRIDGE STORING THE SAME

BACKGROUND OF THE INVENTION

The present invention relates to a staple cartridge and a roll staple and, in particular, to such staple cartridge which is structured such that a roll staple can be loaded easily thereinto and such roll staple which can be loaded easily into such staple cartridge.

There is known an electric stapler using a roll staple which comprises a large number of linear-shaped staples bonded together in parallel and wound into a roll. The roll staple is stored into a staple cartridge before it is used. Conventionally, in general, when the roll staple is used out, the whole staple cartridge is replaced with a new one. However, in view of time and cost necessary for waste disposal, saving of natural resources, destruction of the natural environment, and the like, there is proposed a staple cartridge structured such that the roll staple can be replenished to thereby be able to use the staple cartridge repeatedly.

However, in the staple cartridge of the above type, a high operation efficiency cannot be expected when the roll staple is loaded into the staple cartridge and, therefore, it is urged to facilitate the loading of the roll staple. That is, in the present conventional staple cartridge, after the lid of the cartridge is opened, the roll staple is loaded into a staple loading chamber of the cartridge, and the front portion of the roll staple is inserted into a thin guide groove having a small thickness approximate to the diameter of the roll staple to thereby guide the same onto a staple guide table. In this loading operation, it takes time and labor to insert the roll staple into the guide groove and feed the same up to a position in front of the staple guide table; that is, during this operation, there is a possibility that the roll staple can drop down, the winding of the roll staple can be loosened, and the like.

SUMMARY OF THE INVENTION

Thus, in the above-mentioned staple cartridge, there arises a technical problem to be solved: that is, it is necessary to be able to load the roll staple into the staple cartridge easily and quickly in order to improve the handling efficiency of the staple cartridge.

Accordingly, it is an object of the invention to solve the above technical problem found in the conventional staple cartridge.

It is another object of the invention to provide a staple feed mechanism for use in a roll staple cartridge.

It is still further object of the invention to provide a staple cutting mechanism for use in a roll staple cartridge, which is able to cut a roll staple within the roll staple cartridge simply and safely at a given position.

It is still further object of the invention to provide a staple cutting mechanism for use in a roll staple cartridge which is able to cut off the roll staple positively even with a weak force.

In attaining the above object, according to a first aspect of the present invention, there is provided a staple cartridge for storing a roll staple formed by winding a sheet staple in a roll manner, the sheet staple of linear staples bonded together in parallel, the staple cartridge comprising: a staple loading chamber receiving the roll staple; a staple guide table located downwardly of the staple loading chamber; a staple guide groove communicating from the staple loading chamber to the staple guide table located to feed the sheet staple from the staple loading chamber up to a position located in front of the staple guide table, a lid openably and closably provided on the staple loading chamber to be able to replenish the roll staple; an opening formed in the width-direction central portion of the bottom portion of the staple loading chamber to expose the upper surface of the staple guide table therethrough; and staple guide portions on the two left and right sides of the opening, respectively communicating with the staple guide table.

According to a second aspect of the invention, there is provided a roll staple to be loaded into the staple cartridge of the first aspect, further including a belt wound around the roll staple with one end of the belt bonded peelably to the outer peripheral side end portion of the roll staple, the other end of the belt is peelably bonded to the outer peripheral surface of the roll staple to bind the roll staple, and the width of the belt is smaller than the width of the opening formed in the staple loading chamber of the staple cartridge.

According to a third aspect of the invention, there is provided a roll staple according to the second aspect further including a tab portion on the outer peripheral end portion of the belt, and, a width of the tab portion is larger than the width of the interior portion of the staple loading chamber of the staple cartridge.

According to a fourth aspect of the invention, there is provided a roll staple cartridge according to the first aspect, further comprising: feeding means slidably disposed on the upper or lower surface side of the staple guide groove, wherein the feeding means has a feed pawl portion engageable with the roll staple within the staple guide groove, and a feed lever arranged so as to be exposed to the outside.

According to a fifth aspect of the invention, there is provided a roll staple cartridge according to the first aspect, further comprising: a staple cutting mechanism having a hold portion and a feed portion respectively formed on the upper or lower surface side of the staple guide groove such that the hold and feed portions are respectively engaged with the roll staple within the staple guide groove, wherein the feed portion is externaly operable so as to move back and forth with respect to the staple guide groove while the feed portion is superimposed on the exterior portion of the hold portion, and, with the feed portion and the hold portion respectively engaged with the roll staple, only the feed portion is moved forward to thereby be able to cut the roll staple from between the hold portion and the feed portion.

According to a sixth aspect of the invention, there is provided a roll staple cartridge according to the first aspect, further comprising: a staple cutting mechanism comprising a tape cutter which is disposed on the upper or lower surface side of the staple guide groove and is capable of cutting the connecting tape of the roll staple within the staple guide groove, wherein the tape cutter is externaly operable.

According to a seventh aspect of the invention, there is provided a roll staple cartridge according to the first aspect, further comprising: a staple cutting mechanism having a pressing member movable in a direction parpendicular to the roll staple within the staple guide groove, a pair of cutoff pieces respectively supported on the pressing member such that the cutoff pieces are respectively located along the longitudinal direction of the roll staple, are mutually arranged in a fan-out manner and can be rotated, wherein the leading ends of the two cut-off pieces are respectively butted against the surface of the roll staple within the staple feed passage to push the pressing member to forcibly spread out the gap between the respective leading ends of the two cut-off pieces, to cut off the roll staple.

DETAILED DESCRIPTION OF THE PREFERRED EMBODIMENTS

Figure 1:
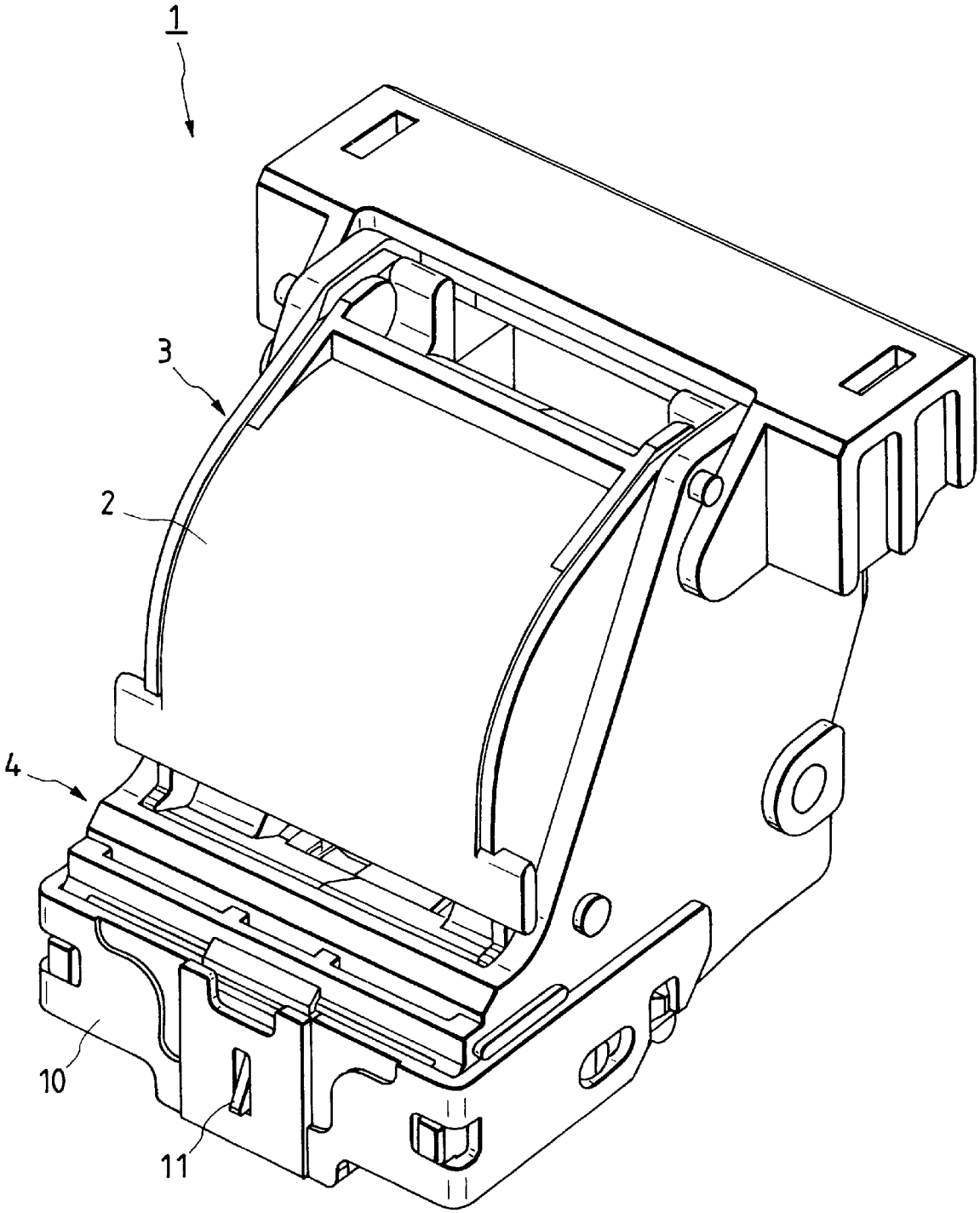
FIG. 1 is a perspective view of a staple cartridge according to an embodiment of the present invention.
Figure 2:
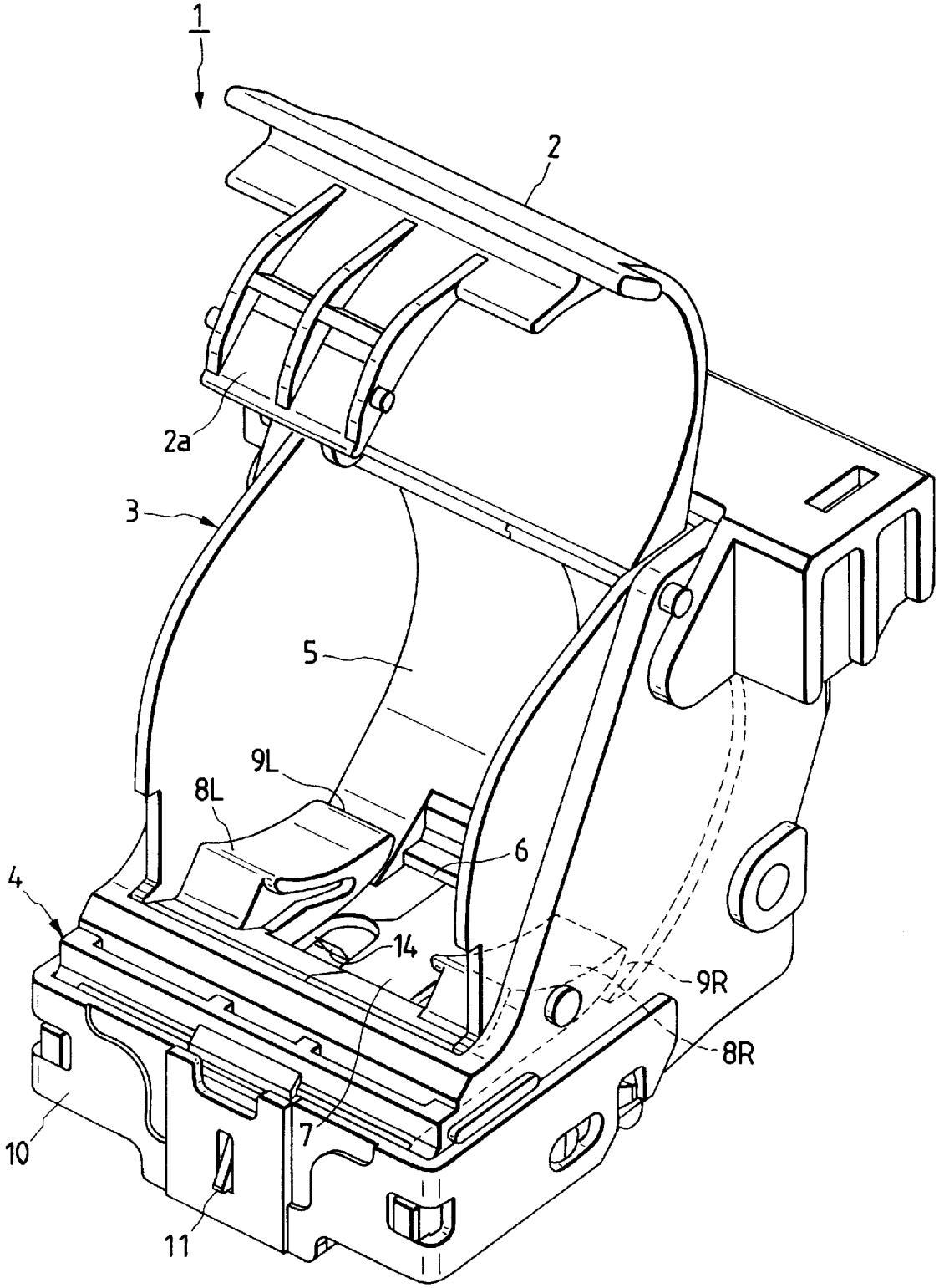
FIG. 2 is a perspective view of the staple cartridge shown in FIG. 1, showing a state thereof in which a front lid thereof is opened.

Now, description will be given below in detail of preferred embodiments of the present invention with reference to the accompanying drawings. At first, FIGS. 1 and 2 respectively show a staple cartridge 1 according to the invention and, in particular, FIG. 2 shows a state of the staple cartridge 1 when a front lid 2 is opened. In the staple cartridge 1, a guide portion 4 extends forwardly from under a staple storage portion 3, while the interior space of a staple loading chamber 5 formed within the staple storage portion 3 is formed in a substantially cylindrical shape.

The front lid 2 is hinge-connected to the upper portion of the left and right wall surfaces of the staple storage portion 3, so that, if the front lid 2 is opened, then the roll staple can be loaded into the staple loading chamber 5 through the opened front lid 2. Also, as shown in FIG. 1, while the front lid 2 is closed, there is present a gap between the guide portion 4 and the front end lower edge portion of the front lid 2; that is, the belt of the roll staple (which will be discussed later) can be pulled out from the present gap.

As shown in FIG. 2, in the left-and-right-direction center of the bottom portion of the staple loading chamber 5, there is formed an opening 6. The left-and-right-direction central portion of the upper surface of a staple guide table 7 is exposed through the opening 6. The roll staple is to be carried on concave-shaped bottom surface portions 8L and 8R which are situated on the left and right sides of the opening 6 respectively. On the two left and right sides of the opening 6 that are located adjacent to the rear end portion of the opening 6, there are formed staple guide grooves 9L and 9R which respectively communicate from the staple loading chamber 5 to the staple guide table 7.

In the front lid 2 which is curved in an arc shape, there is provided a bottom surface portion 2*a* which is formed in such a manner as to extend in the peripheral direction from the front end central portion of the front lid 2. When the front lid 2 is closed, the bottom surface portion 2*a* becomes almost flush with the bottom surface portions 8L and 8R of the staple loading chamber 5 to thereby be able to cover the portions of the opening 6 that are present in front of the staple guide grooves 9L and 9R.

Figure 3:
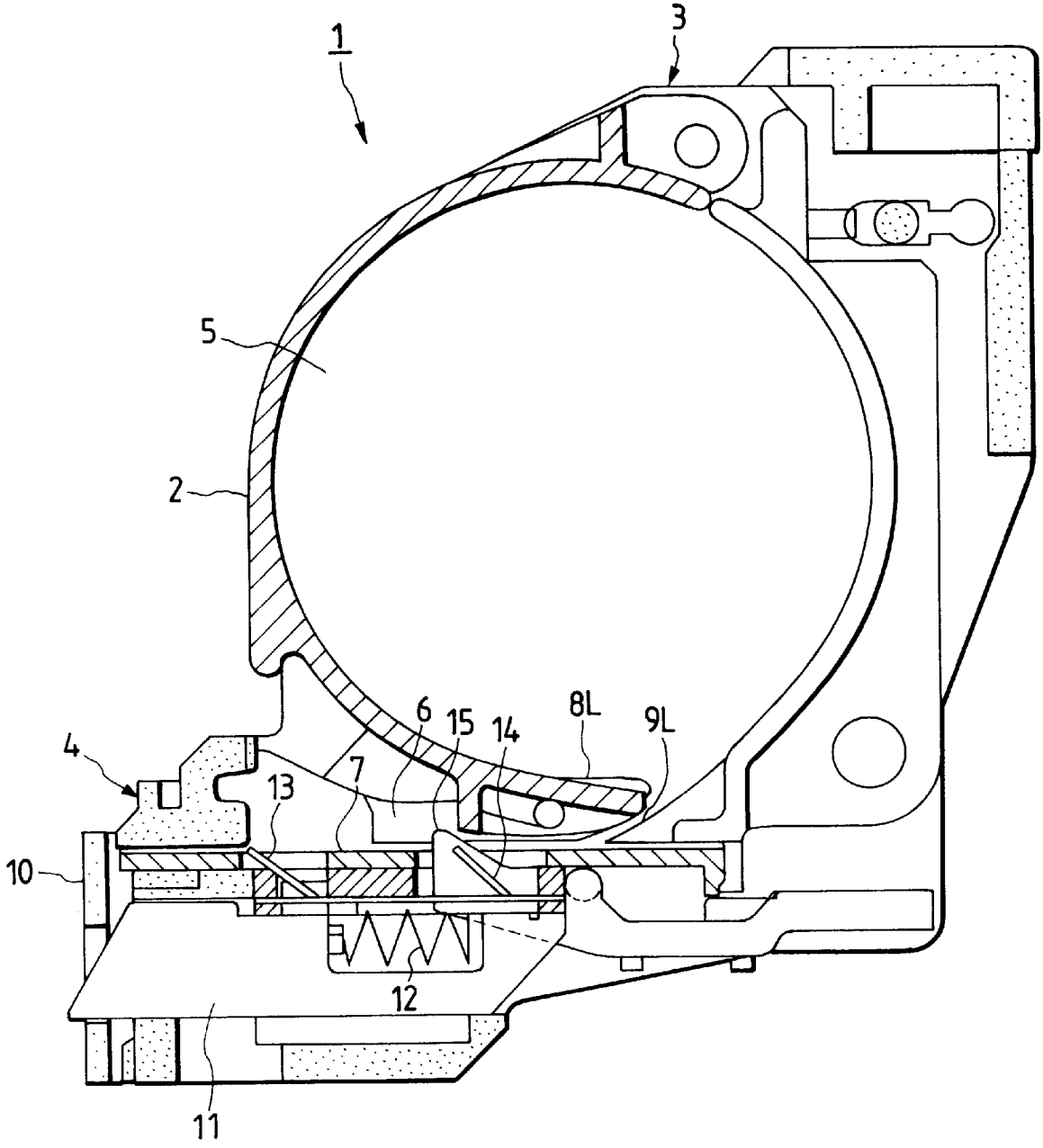
FIG. 3 is a side section view of the staple cartridge shown in FIG. 1.

As shown in FIG. 3, the staple guide table 7 is disposed within the guide portion 4. A sheet staple, which is to be fed forwardly on the staple guide table 7, is contacted with a front end plate 10 mounted on the guide portion 4 and is thereby caused to stop there. A driver and a forming plate, which are respectively included in an electric stapler (not shown), are moved upward or downward within a gap between the guide portion 4 and front end plate 10. At the same time when the driver ejects the front-row staple, the forming plate folds downward the two left and right end portions of a linear-shaped staple in the third row to thereby form the staple into a gate shape.

Below the staple guide table 7, there is mounted a driven cam plate 11 which can be freely slided in the back-and-forth direction of the staple guide plate 7. The cam plate 11 is energized forwardly by a spring 12. The front end inclined surface of the cam plate 11 projects into a gap between the guide portion 4 and front end plate 10. On the front and rear sides of the cam plate 11, there are provided two feed pawls 13 and 14 each of a ratchet type; and, the two feed pawls 13 and 14 respectively project upwardly through their associated holes respectively formed in the staple guide table 7. When a sheet staple is present on the staple guide table 7, the two feed pawls 13 and 14 are respectively pressed against the lower surface of the sheet staple.

When the staple is ejected by the electric stapler, the lowering driver is contacted with the front end inclined surface of the cam plate 11 to thereby move back the cam plate 11, while the two feed pawls 13 and 14 are moved back while they are left in contact with the lower surface of the sheet staple. If the driver moves upward beyond a lowermost position, then the cam plate 11 is allowed to advance because it is removed from the pressure by the driver and, at the then time, the feed pawls 13 and 14 are respectively engaged with recessed portions respectively formed in the respective staples of the sheet staple and thus can feed the sheet staple forwardly.

Also, in the rear of the cam plate 11, there is mounted a staple detect lever 15 in such a manner that it can be freely turned in the vertical direction. The staple detect lever 15 is energized by a spring (not shown) in a direction where the front end portion thereof can be raised. As shown in FIG. 3, if any sheet staple is not present on the staple guide table 7, then the front end portion of the staple detect lever 15 projects upwardly through a hole formed in the staple guide table 7. Otherwise, if a sheet staple is present on the staple guide table 7, then the front end portion of the staple detect lever 15 is pressed down by the sheet staple.

In the electric stapler, there is disposed a photo interrupter which is situated in the rear end portion of the staple detect lever 15. Particulary, when the rear end portion of the sheet staple passes through the front end portion of the staple detect lever 15, the front end portion of the staple detect lever 15 projects upwardly through the hole of the stapler guide table 7, whereas the rear end portion thereof is lowered to advance into between the light emitting and receiving elements of the photo interrupter. At the then time, the output of the photo interrupter is turned off and thus, in accordance with an off signal from the photo interrupter, a control circuit for the electric stapler prohibits the start of a motor, while such motor start prohibit state continues until a new staple is replenished.

Figure 4A:
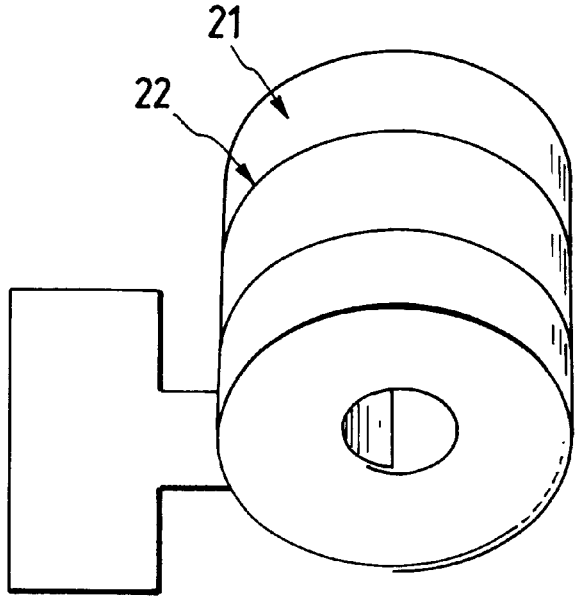
FIG. 4(*a*) is a perspective view of a roll staple according to an embodiment of the invention, showing a state thereof before it is used, and FIG. 4(*b*) is a perspective view thereof, showing a state thereof in which a belt is loosened with respect to the roll staple.
Figure 4B:
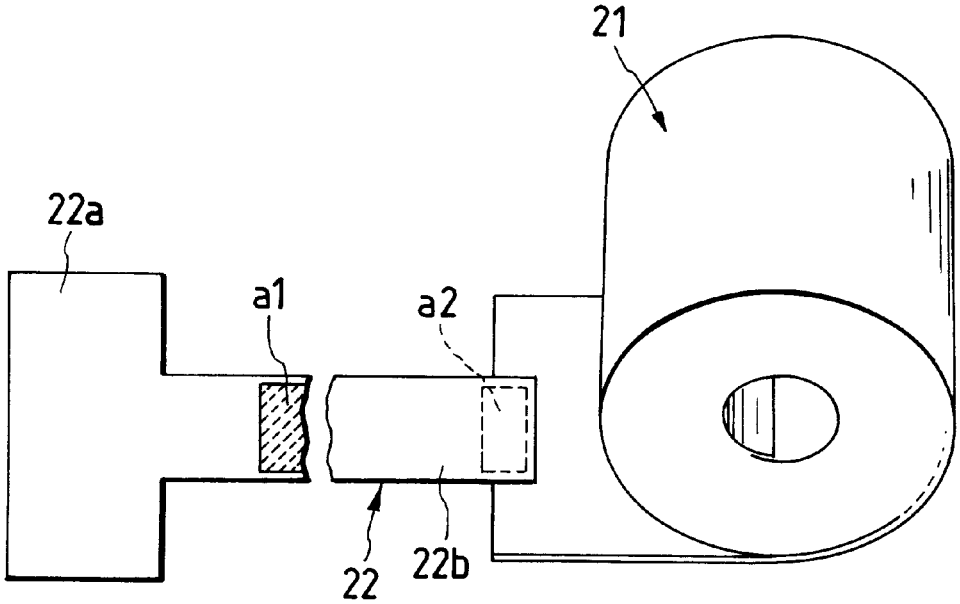

As shown in FIG. 4(*a*), a roll staple 21 is provided to users in such a manner that a belt 22 such as paper, resin film or the like is wound around the outer periphery thereof. The rear end portion of the belt 22 is bonded to the front portion of the roll staple 21, the belt 22 is wound around the roll staple 21, and the front neighboring portion of the belt 22 is bonded to the outer peripheral surface of the roll staple 21.

The belt 22 is bonded with an adhesive such as a tacky producer or the like which can be peeled off; that is, if the outer peripheral side bonded portion al of the belt 22 is peeled off, then, as shown in FIG. 4(*b*), the belt 22 comes loose. And, if the belt is pulled further with the roll staple 21 fixed, then the rear end bonded portion a2 of the belt 22 can be peeled off from the front portion of the roll staple 21.

In the front portion of the belt 22, there is formed a tab portion 22*a* having a large width. In particular, the width of the tab portion 22*a* is larger than the width of the staple loading chamber 5 of the staple cartridge 1, while the width of the remaining belt portion 22*b* is smaller than the width of the bottom surface opening 6 of the staple loading chamber 5.

Figure 5:
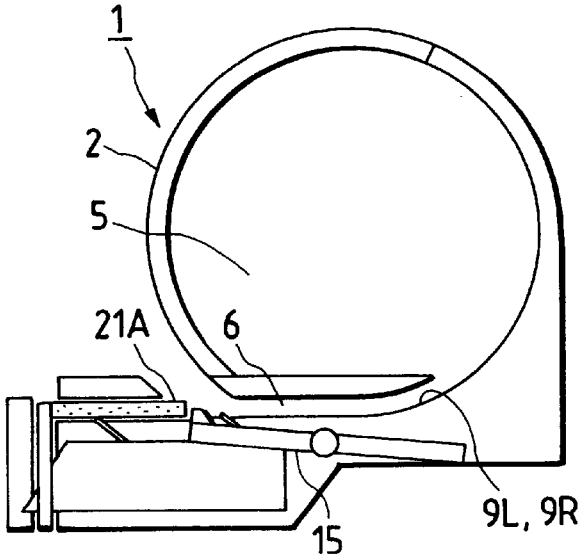
FIG. 5 is an explanatory view of a procedure for loading a roll staple into a staple cartridge, showing schematically a state in which no roll staple is loaded in the staple cartridge.

Next, description will be given below of a procedure for loading the roll staple 21 into the staple cartridge 1 with reference to schematic views respectively shown in FIGS. 5 to 9. At first, FIG. 5 shows a state in which a roll staple 21A within the staple cartridge 1 is consumed and the rear end portion of the roll staple 21A is moved forwardly beyond the front end portion of the above-mentioned staple detect lever 15; and, in this state, the electric stapler is held in a start prohibit state until a new roll staple is replenished.

Figure 6:
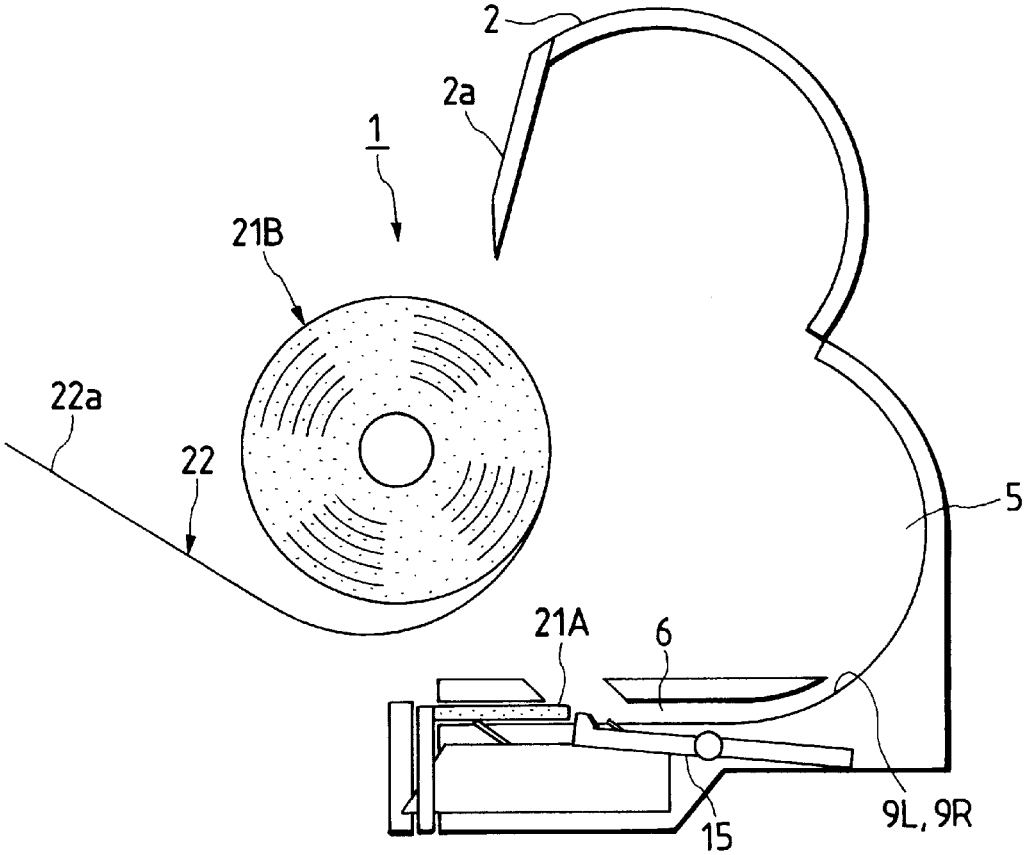
FIG. 6 is also an explanatory view of a procedure for loading a roll staple into a staple cartridge following the roll staple loading procedure shown in FIG. 5, showing schematically the state of the staple cartridge and roll staple in which the front lid thereof is opened.

As shown in FIG. 6, after the front lid 2 is rotated upwardly to thereby open the staple loading chamber 5, if a new roll staple 21B is inserted into the staple loading chamber 5, then the tab portion 22*a* of the belt 22 shown in FIG. 4 is not able to advance into the staple loading chamber 5 but remains outside the staple loading chamber 5 because the tab portion 22*a* is larger in width than the staple loading chamber 5.

Figure 7:
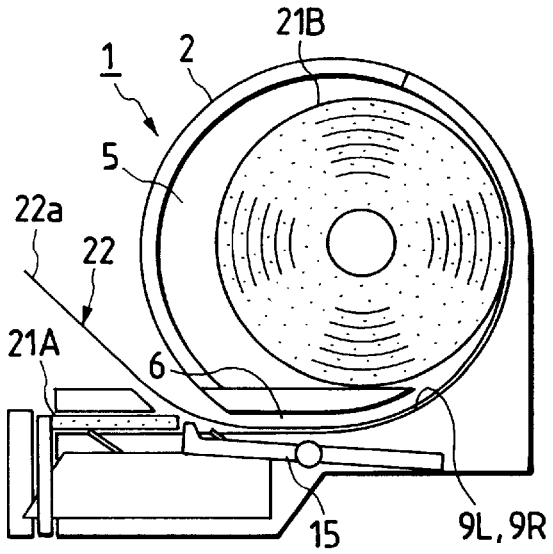
FIG. 7 is a further explanatory view of a procedure for loading a roll staple into a staple cartridge following the roll staple loading procedure shown in FIG. 6, showing schematically the state of the staple cartridge and roll staple in which the front lid thereof is closed.

As shown in FIG. 7, if the front lid 2 is closed, then the belt 22 stays outwardly of the staple loading chamber 5 from between the opening 6 and the lower surface of the bottom surface portion 2*a* of the front lid 2. The tab portion 22*a* of the belt 22 is pulled forwardly, then the roll staple 21B is rotated within the staple loading chamber 5 and, at the same time, the outer peripheral side bonded portion of the belt 22 is peeled off so that the belt 22 can be pulled out.

Figure 8:
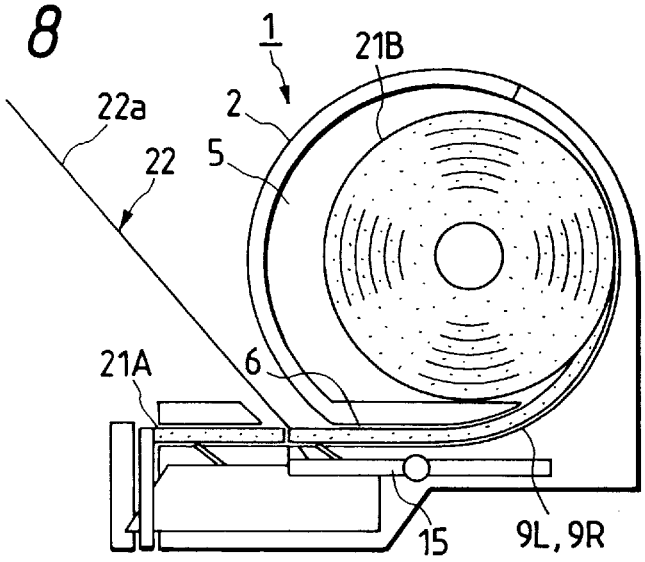
FIG. 8 is a still further explanatory view of a procedure for loading a roll staple into a staple cartridge following the roll staple loading procedure shown in FIG. 7, showing schematically the state of the staple cartridge and roll staple in which the tab portion of the roll staple is pulled.

And, as shown in FIG. 8, the front portion of the roll staple 21B is pulled by the belt 22 and is thereby moved forwardly along the inner peripheral surface of the staple loading chamber 5, so that the front portion of the roll staple 21B is guided into the left and right staple guide grooves 9L and 9R of the opening 6. The front portion of the roll staple 21B, which moves on the staple guide table, not only presses down the front end portion of the staple detect lever 15, but also is butted against the tail end of the staple 21A remaining within the guide portion 4 so that the advancing motion thereof is stopped there by the tail end of the staple 21A.

Figure 9:
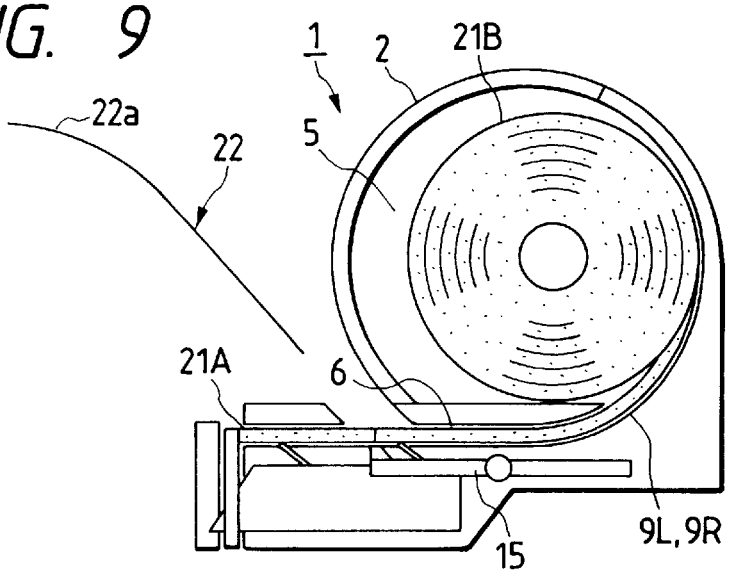
FIG. 9 is a yet further explanatory view of a procedure for loading a roll staple into a staple cartridge following the roll staple loading procedure shown in FIG. 8, showing schematically the state of the staple cartridge and roll staple in which the loading of the roll staple is completed.

And, if the belt 22 is pulled still further, then, as shown in FIG. 9, the rear end portion of the belt 22 is peeled off the front portion of the roll staple 21B and is thereby taken out from the staple cartridge 1, so that the staple cartridge 1 is now in a re-usable state.

If the roll staple 21 is loaded into a staple cartridge 1 within which no staple is left at all, at the time when the front portion of the staple is pulled into the staple guide table 7 to a certain degree and the bonded portion between the belt 22 and roll staple 21 arrives at the pulling-direction line of the belt 22, the roll staple 21 is caused to stop its advancing motion and the belt 22 is peeled off the roll staple 21.

The present staple cartridge 1 is structured such that a conventional type of roll staple can also be loaded thereinto. In this case, if the front portion of the roll staple is inserted into the staple guide grooves 9L and 9R and, with the front lid 2 opened, the staple exposed to the opening 6 is fed forwardly by a finger, then the roll staple can be inserted up to a given position more easily than in the conventional staple cartridge.

A feeding mechanism according to an embodiment of the present invention will described in detail.

Figure 10:
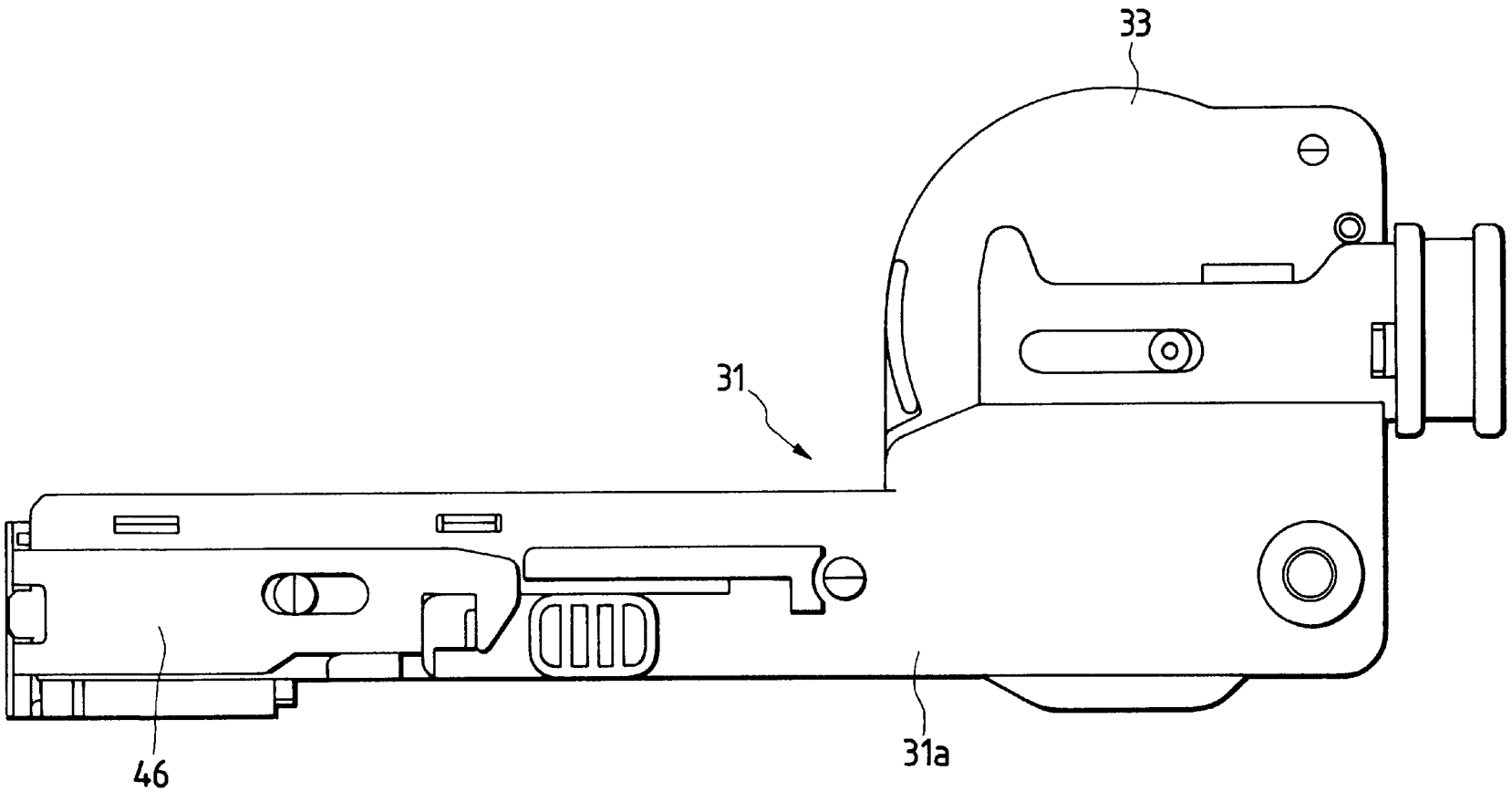
FIG. 10 is a side view of a roll staple cartridge to which a feeding mechanism according to an embodiment of the present invention is applied.
Figure 11:
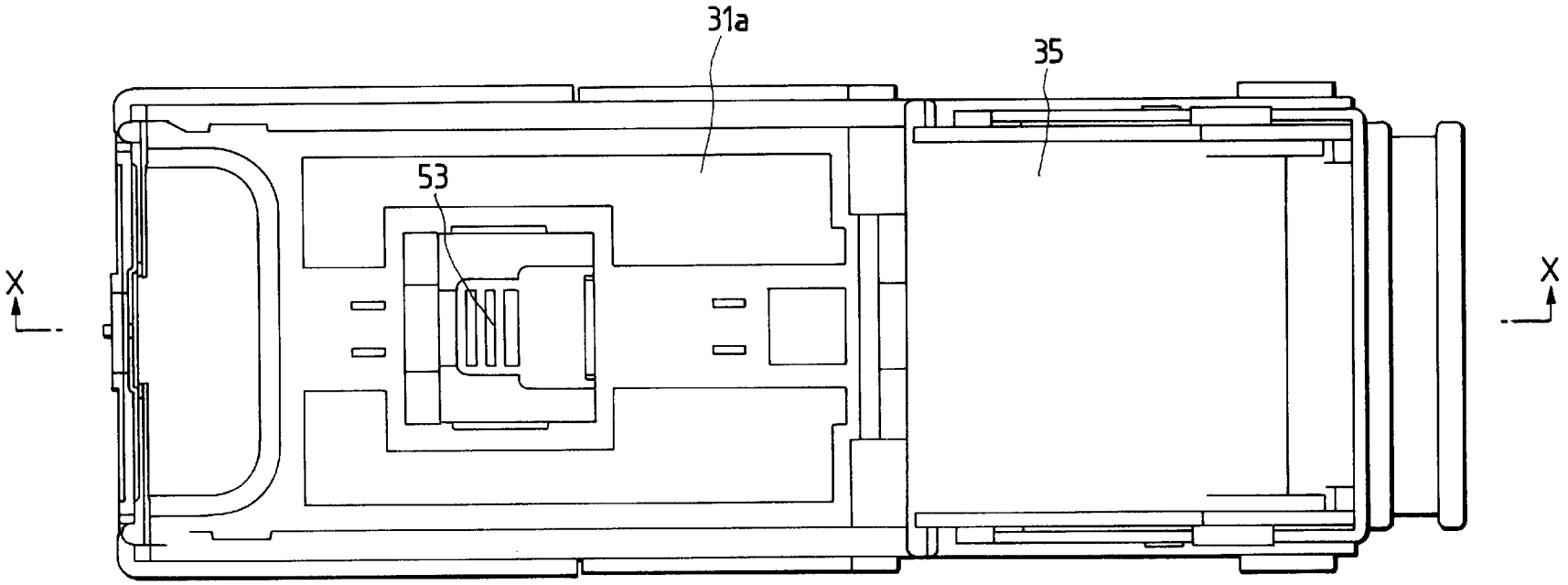
FIG. 11 is a plan view of a roll staple cartridge.
Figure 12:
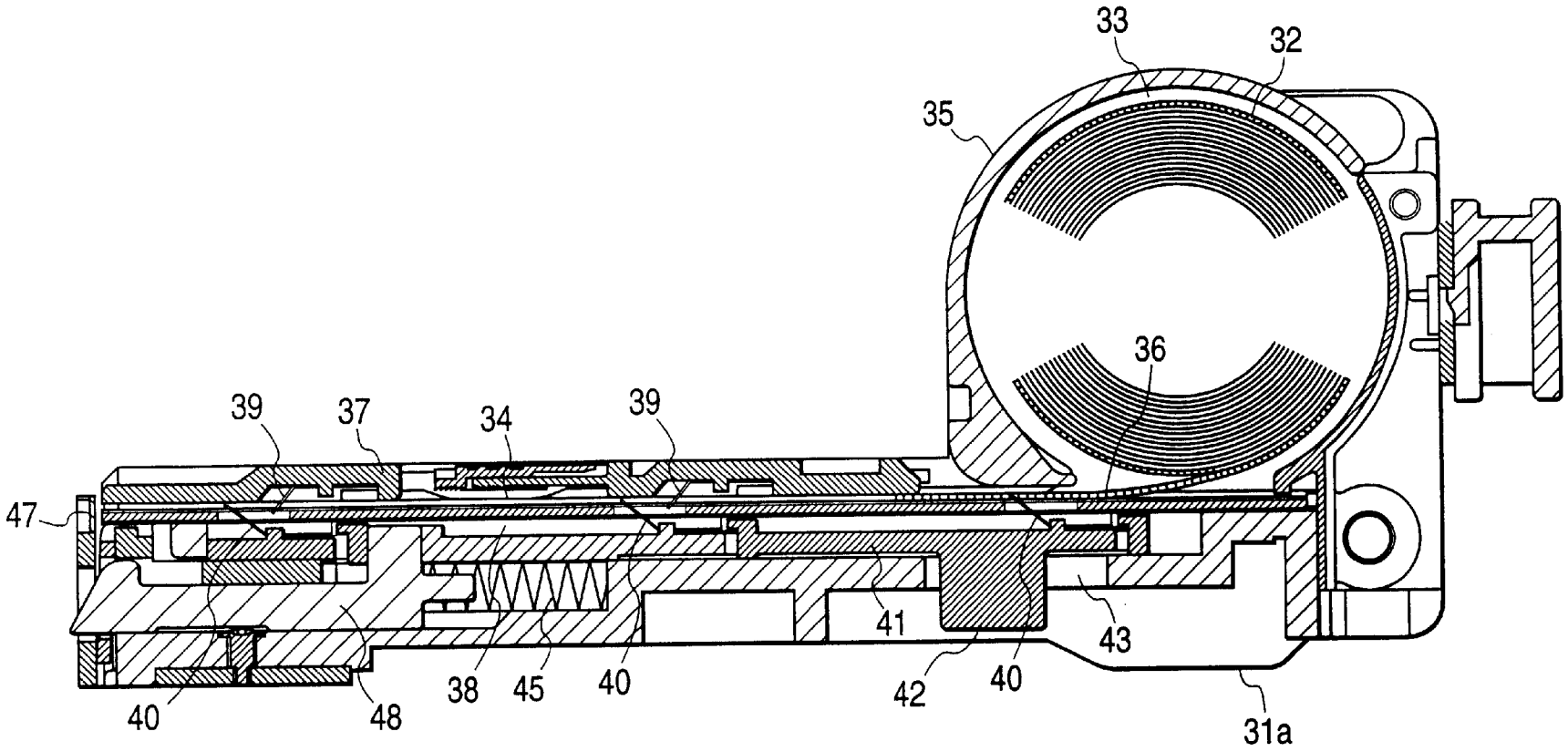
FIG. 12 is a section view taken along the line X—X shown in FIG. 11.

In FIGS. 10 to 12, a roll staple cartridge 31 comprises a cartridge main body 31*a* including a storage portion 33 for storage of a roll staple 32 and a staple feed passage 34. The roll staple 32 is stored in the roll staple storage portion 33. The roll staple 32 comprises a plurality of linear-shaped staples connected together with adhesive tape and wound in a roll manner.

The storage portion 33 is opened in the bottom portion thereof to thereby provide an opening 36; that is, the roll staple cartridge 31 is structured such that, the outer-most end portion of the roll staple 32 can be guided out from the opening 36 and then can be fed within the staple feed passage 34. Also, a cap 35 is mounted on the top portion of the storage portion 33, that is, the cap 35 must be opened before the roll staple 32 can be stored into the storage portion 33.

Figure 13:
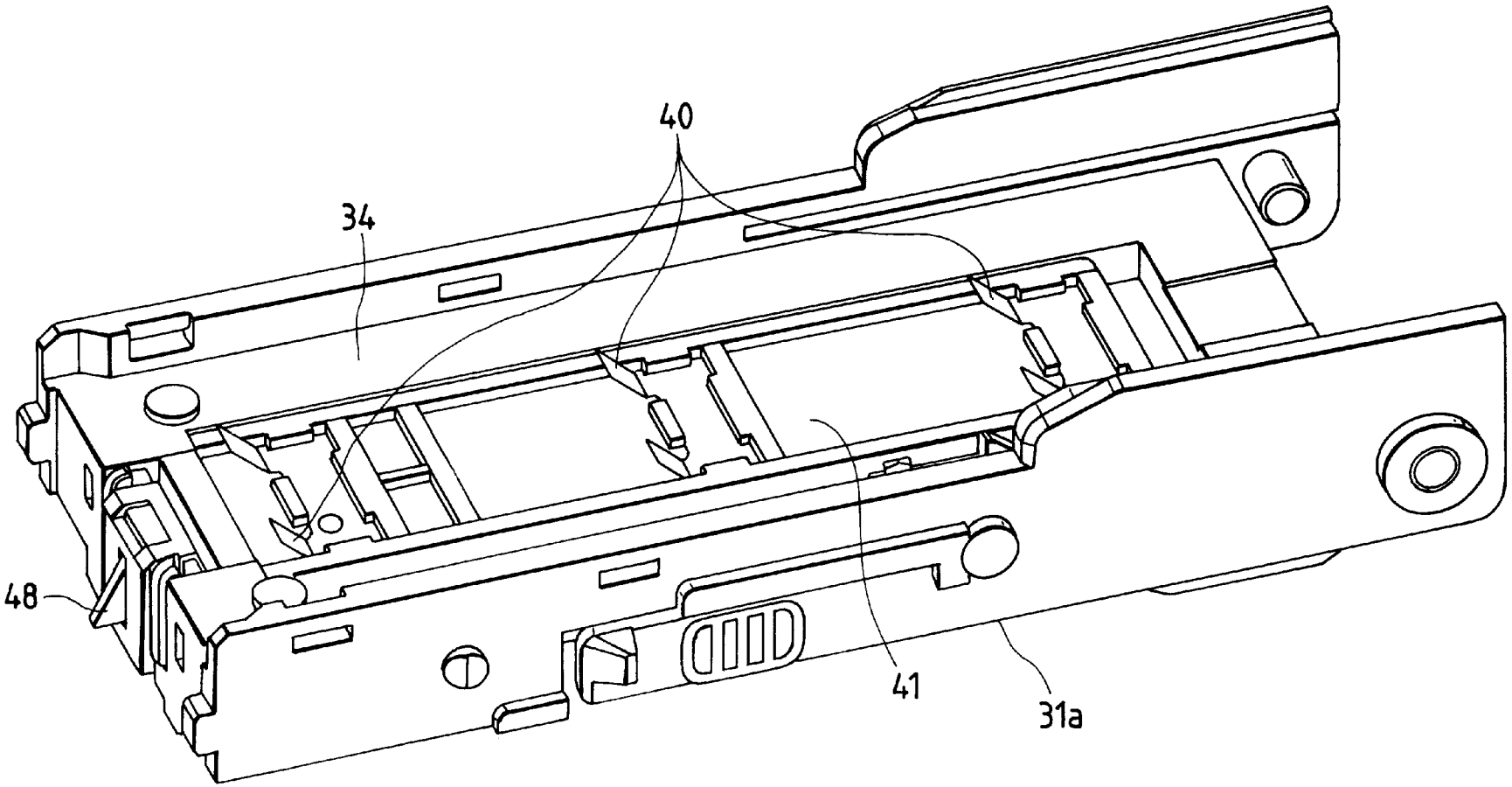
FIG. 13 is a perspective view of a feed mechanism portion of a main body of the roll staple cartridge.

The staple feed passage 34, which is formed in such a manner as to continue with the opening 36 of the storage portion 33, is interposed between an upper guide plate 37 and a lower guide plate 38. And, on the lower surface of the upper guide plate 37, there are provided two reversal check pawls 39 which are respectively inclined forwardly and are used to prevent the backward movement of the roll staple 32 after it has moved to a position in front of the staple feed passage 34. Also, the rear portion of the lower guide plate 8 is opened. A feed plate 41 is disposed on the lower surface side of the lower guide plate 38 in such a manner that it can be moved in the back-and-forth direction of the lower guide plate 38. As shown in detail in FIG. 13, on the upper surface of the feed plate 41, there are fixedly arranged three feed pawls 40 in such a manner that they are respectively inclined forwardly; and, the three feed pawls 40 respectively project into the staple feed passage 34 from the open portion of the lower guide plate 38. And, a feed lever 42 is provided in such a manner that it is exposed downwardly from the lower surface of the feed plate 41. The feed lever 42 extends through an open hole 43 formed in the lower portion of the cartridge main body 31*a* and projects out to the outside. Further, the feed lever 42 is structured such that it is able to move within the interior portion of the open hole 43, while the amount of movement of the feed lever 42 provides the range of movement of the feed plate 41.

Figure 14:
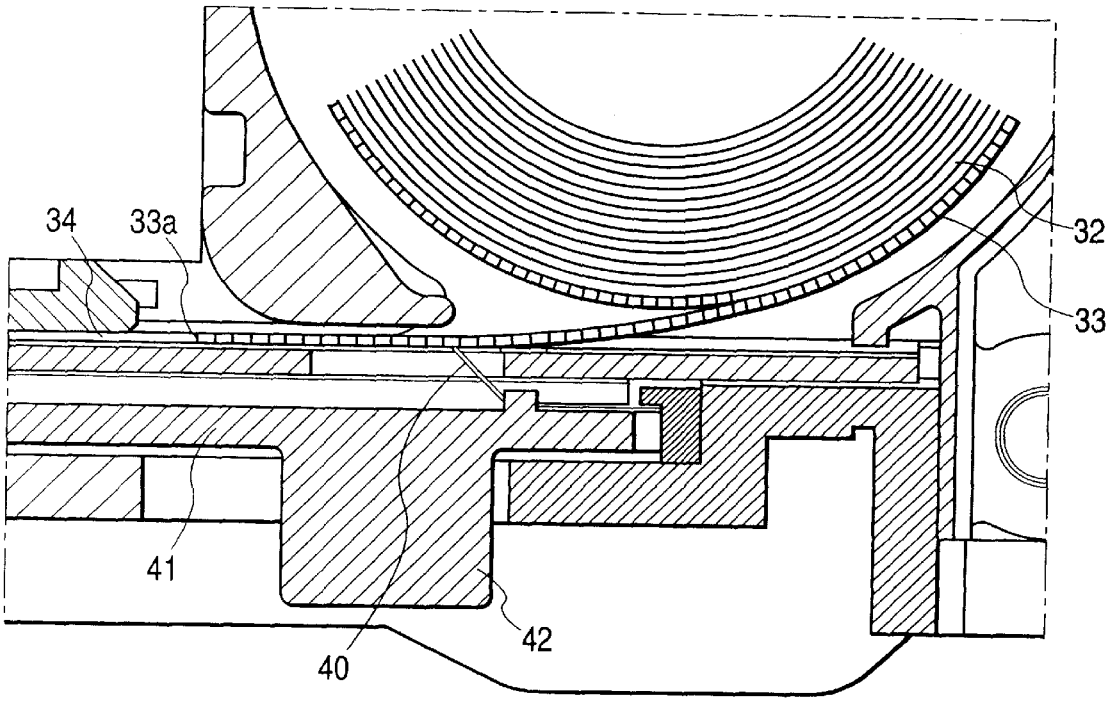
FIG. 14 is an enlarged view of a feed passage for explaining the operation of the feed mechanism portion.
Figure 15:
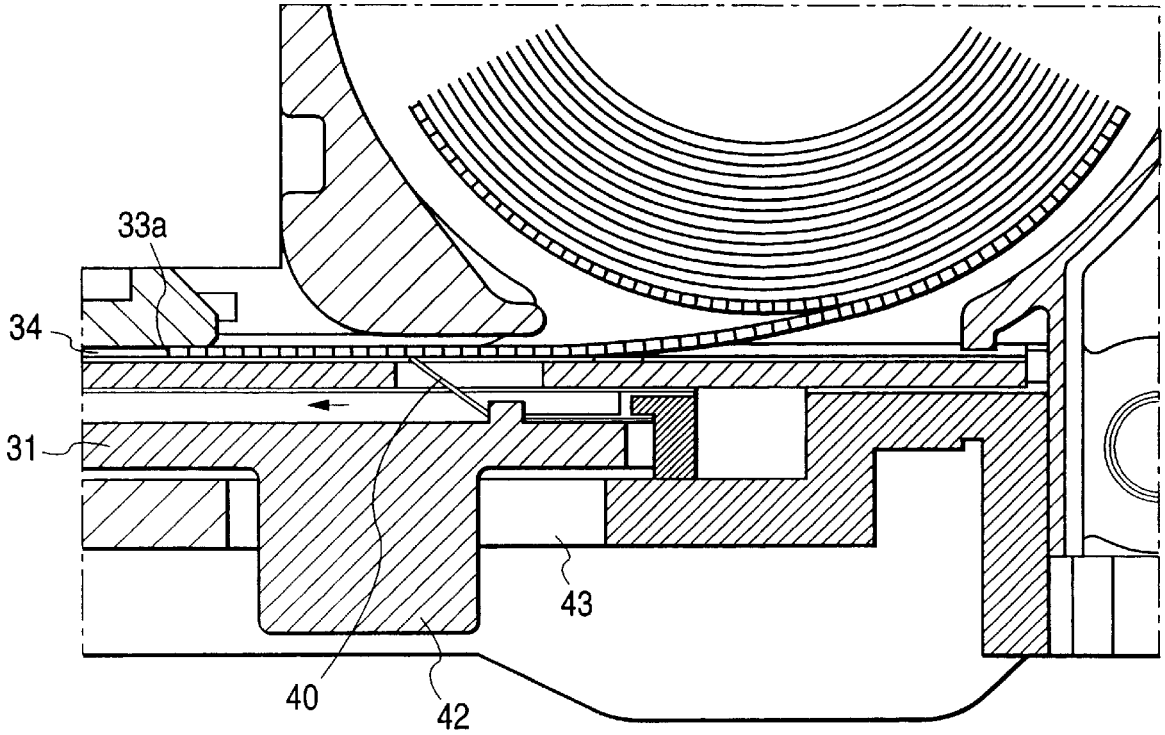
FIG. 15 is an enlarged view of a feed passage for explaining the operation of the feed mechanism portion.

In the above-mentioned structure, as shown in FIG. 14, after the leading end of the roll staple 32 stored within the storage portion 3 is guided into the interior portion of the staple feed passage 34 to a slight extent from the opening 36, if the feed plate 41 is moved back and forth while holding the feed lever 42, in particular, as shown in FIG. 15, if the feed plate 41 is moved forward, then the feed pawl 40 of the feed plate 41 is engaged with the roll staple 32, so that the roll staple 32 is fed out by an amount equivalent to the amount of movement of the feed plate 41. On the other hand, if the feed plate 41 is moved backward, then the roll staple 32 is unable to move backward because the backward check pawls 39 are in engagement with the roll staple 32. In this manner, the roll staple 32 can be fed out by the same amount as the movement of the feed lever 42.

In the front end of the staple feed passage 4, there is provided a face plate (not shown). On the back surface of the face plate, there are formed vertically-extending striking grooves into which the formed staple can be struck; that is, the staple, which is guided out from the staple feed passage 34 and is formed into a U shape by forming means (not shown), is struck into the striking grooves. In the striking operation, even if the staple is struck poorly or improperly, the staple jammed or clogged in the striking grooves can be dealt with properly in the following manner: that is, if the face plate is opened, then the jammed or clogged staple can be removed from the striking grooves, and, after then, the face plate is closed again and the roll staple 32 may be fed forward together with the feed plate 41 by the feed lever 42.

A ratchet plate 48 is fixed to the feed plate 41 and is also energized forward by a compression spring 45. When the electric stapler is in operation, by operating the ratchet plate 48, the feed plate 41 can be moved back and forth, thereby being able to feed the roll staple.

As described above, since the feed amount of the roll staple 32 is equal to the feed amount of the feed plate 41, the feed amount of the roll staple 32 can be adjusted properly from the outside. Also, because the feeding operation of the feed plate 41 can be carried out by using the feed lever 42 which is projected to the outside, the feeding operation of the feed plate 41 and thus the roll staple can be executed in a simple manner.

In the above-mentioned embodiment, the feeding means is formed in a plate shape such as the above-mentioned feed plate 41. However, this is not always limitative but, according to the invention, the feed means can also be formed in different shapes. Also, the feeding means can also be disposed on the upper surface side of the staple feed passage 34.

Moreover, description will be given below of a staple cutting mechanism for use in a roll staple cartridge according to an embodiment of the invention with reference to the accompanying drawings.

Figure 16:
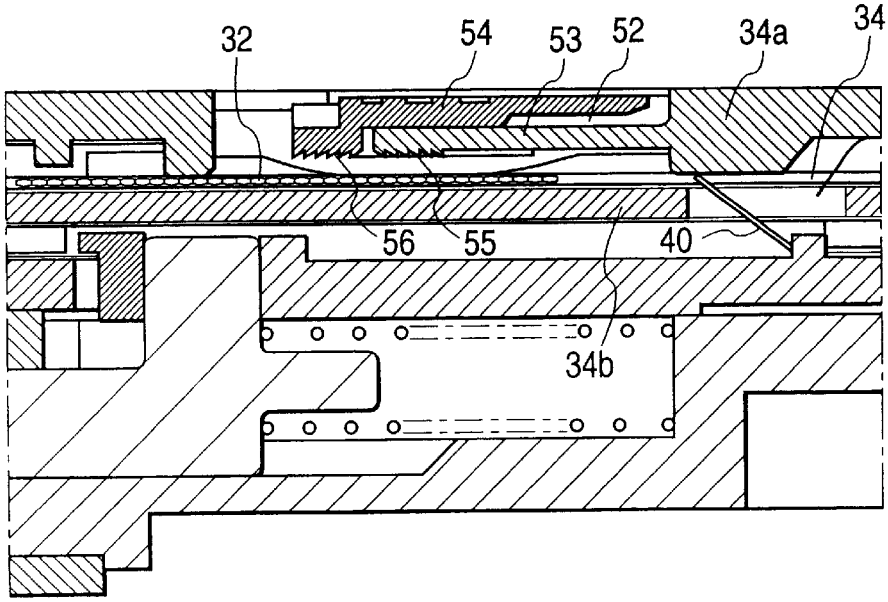
FIG. 16 is an enlarged section view of a cutting mechanism portion according to an embodiment of the invention.

In the open portion 12 of the upper guide plate 4*a* of the staple feed passage 34, as shown in detail in FIG. 16, there are formed a hold portion 53 and a feed portion 54. The hold portion 53 is formed in such a manner that it projects forward from the upper guide plate 34*a* and can be flexed upward and downward; and, on the lower surface of the leading end portion of the hold portion 53, there is formed a saw-tooth-shaped engaging tooth portion 55 in such a manner that, when it is pressed from above, then it can be engaged with the upper surface of the roll staple 32 within the staple feed passage 34. On the other hand, the feed portion 54 is structured such that, while it is superimposed on the upper portion of the hold portion 53, it can be moved back and forth. And, the feed portion 54 is exposed to the outside, the front end portion thereof is bent downward, and, on the lower surface of the bent front end portion, there is formed an engaging tooth portion 56. The engaging tooth portion 56 is disposed in such a manner as to be flush with the engaging tooth portion 55 of the hold portion 53, whereas the direction of the teeth of the engaging tooth portion 56 is opposite to that of the engaging tooth portion 55.

Figure 17:
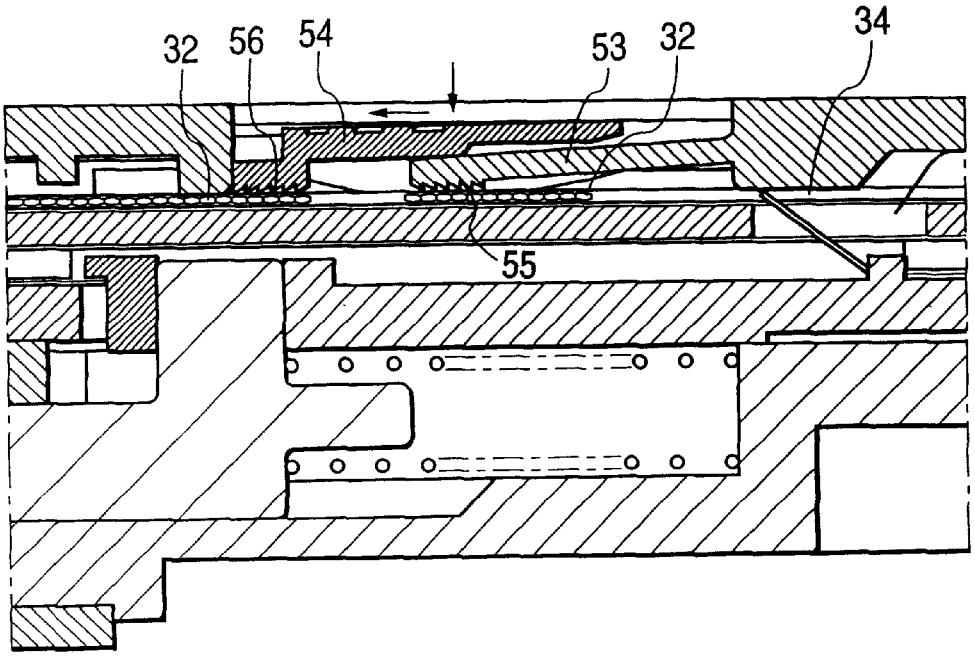
FIG. 17 is an explanatory view of the operation of the staple cutting mechanism.

In the above-mentioned structure, when cutting the roll staple 32, as shown in FIG. 17, while holding the feed portion 54 with a finger, the feed portion 54 is moved forward from the open portion 52 of the upper portion of the staple feed passage 34. In particular, if the feed portion 54 is held, then the hold portion 53 is flexed and the engaging tooth portion 55 of the leading end lower surface of the hold portion 53 is thereby engaged with the upper surface of the roll staple 32 within the staple feed passage 34, thereby being able to prevent the roll staple 32 from moving forward; and, at the same time, the engaging tooth portion 56 of the lower surface of the leading end bent portion of the feed portion 54 is also engaged with the upper surface of the roll staple 32. Also, if the feed portion 54 is moved forward, then the roll staple 32 is forced to move forward. In this manner, since the roll staple 32 is prevented from moving forward by one engaging tooth portion 55 but is moved forward by the other engaging tooth portion 56, the roll staple 2 is cut and separated from between the two engaging tooth portions 55 and 56. The front portion 32*a* of the thus cut roll staple 32 can be pulled out from the front end of the roll staple cartridge 31 and can be disposed of there.

According to the invention, alternatively, the hold portion 53 and feed portion 54 can also be formed on the lower surface side of the staple feed passage 34.

Figure 18:
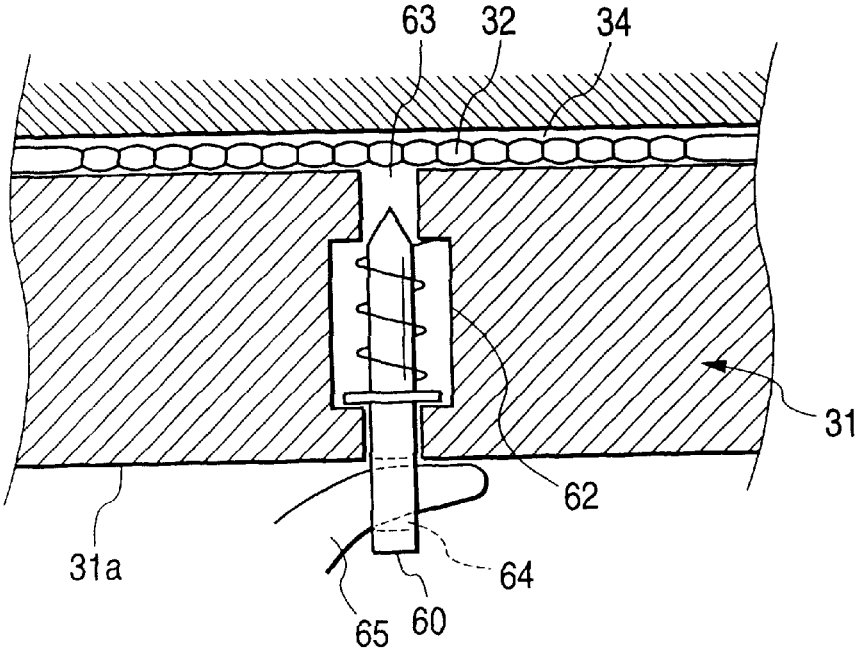
FIG. 18 is a section view of a staple cutting mechanism according to another embodiment of the invention.

Next, FIG. 18 shows a tape cutting mechanism according to another embodiment of the invention. In the present embodiment, a tape cutter 60 is disposed on the lower surface side of the staple feed passage 34. In the front end bottom portion of the cartridge main body 31*a*, there is formed a cutter insertion hole 61 in such a manner as to extend therethrough; and, in the cutter insertion hole 61, there is disposed the tape cutter 60 in such a manner that it can be freely advanced into and retreated from the staple feed passage 34, while the tape cutter 60 is normally energized by a compression spring 62 in such a manner as to retreat from the staple feed passage 34. Further, the lower portion of the tape cutter 60 projects downwardly of the cartridge main body 31*a*.

Generally, when a staple is clogged or jammed due to the buckling thereof or the like in the striking operation, the cartridge main body 31*a* is taken out from the stapler main body and, after then, the clogged staple must be removed. In such case, according to the above-mentioned structure, the tape cutter 60 exposed from the cartridge main body 31*a* is operated or pushed in to thereby cut a connecting tape 63 which connects the staples together. After the roll staple 32 is cut, the front portion of the roll staple 32 can be pulled out from the front portion of the staple feed passage 34 using the above-mentioned feed lever 42 or the like and then can be disposed of there. After completion of the cutting operation, the tape cutter 60 is returned to its original position and the staple cartridge main body 31*a* is set in the stapler main body again.

Preferably, there may be formed an engaging hole 64 in the lower portion of the tape cutter 60 and, when the roll staple cartridge 31 is set in the stapler main body, the engaging hole 64 may be engaged with a hook 65 provided in the stapler main body, thereby preventing the tape cutter 60 against movement. That is, if the roll staple cartridge 31 is taken out from the stapler main body, then the tape cutter 60 can be operated.

Also, preferably, the tape cutter 60 may be disposed in such a manner as to correspond to the connecting tape side of the roll staple 32 within the staple feed passage 4; that is, when the connecting tape is disposed on the upper surface side of the staple feed passage 34, the tape cutter 60 may be disposed on the upper surface side of the staple feed passage 34.

A staple cutting mechanism according to another embodiment of the invention will be described.

Figure 19:
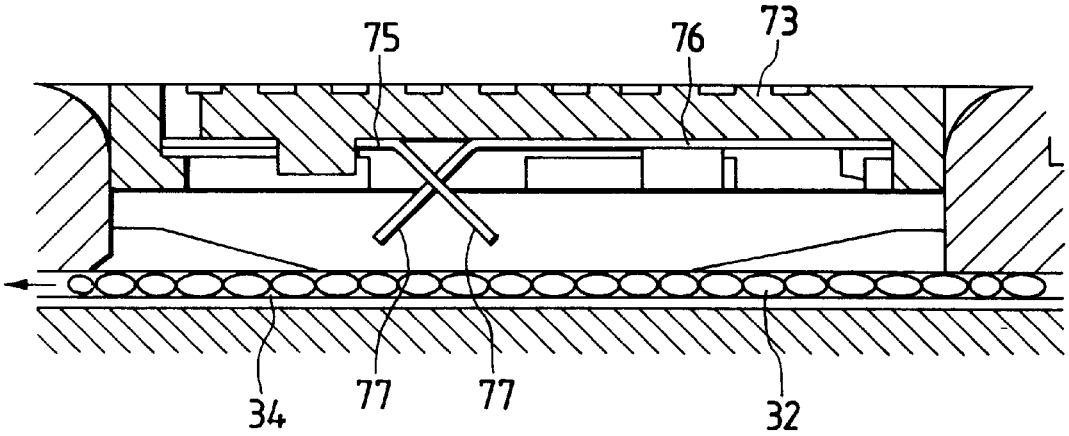
FIG. 19 is an enlarged section view of a staple cutting mechanism according to another embodiment of the invention.

As shown in FIG. 19, in an opening 12 which is formed substantially in the central portion of the upper guide plate 34*a* of the staple feed passage 34, there is disposed a pressing member 73. The pressing member 73, as shown in detail in FIG. 19, is structured such that it can be moved in a direction at right angles to the roll staple 32 within the staple feed passage 34. In the lower surface of the pressing member 73, there is formed a recessed portion 74.

Figure 20:
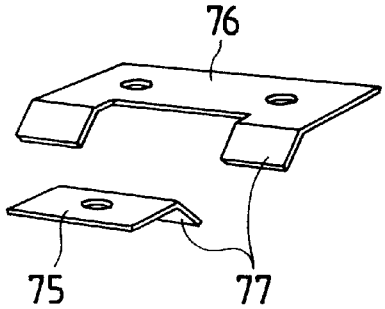
FIG. 20 is an explanatory view of the operation of the above staple cutting mechanism.

To the recessed portion 74, there are fixed two cut-off pieces 75 and 76 which are respectively formed of a metal plate. The two cut-off pieces 75 and 76 are respectively bent in such a manner as shown in FIG. 20 to thereby form pawl portions therein. In particular, two pawl portions 77 are formed in one cut-off piece 75, whereas a single pawl portion 77 is formed in the center of the other cut-off piece 76. The two cut-off pieces 75 and 76 are respectively fixed to the lower surface of the pressing member 73, while the pawl portions 77 are made to intersect each other in a fan-out manner.

Figure 21:
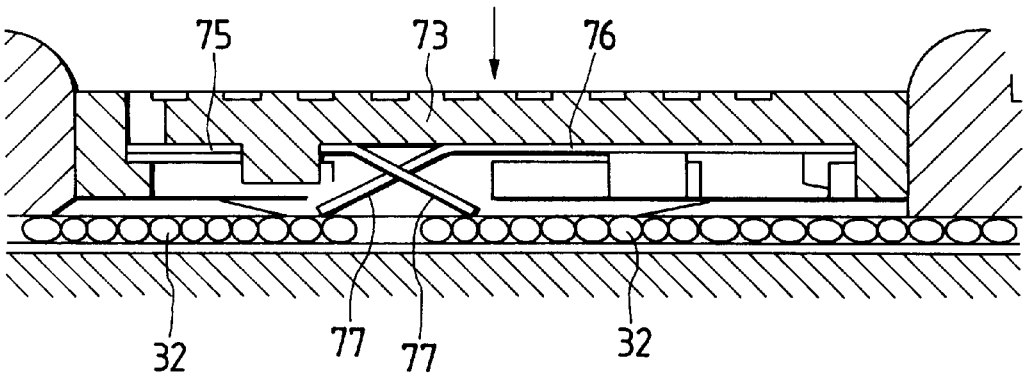
FIG. 21 is a perspective view of cut-off pieces employed in the above staple cutting mechanism.

In the above-mentioned structure, to cut the roll staple 32, as shown in FIG. 21, the pressing member 73 is pushed into the staple feed passage 34. That is, if the pressing member 73 is pushed into the staple feed passage 34, then the pawl portions 77 of the two cut-off pieces 75 and 76 are respectively abutted against the surface of the roll staple 32 within the staple feed passage 34, so that the pawl portions 77 are prevented from moving downward any further. If the pressing member 73 is pushed further, then the pawl portions 77 on the two sides are forcibly spread in the lateral direction, so that the roll staple 32 is pulled strongly in the mutually opposite directions by the two cut-off pieces 75 and 76. As a result of this, the roll staple 32 is cut off. The thus cut-off roll staple 32 may be fed forward by moving the feed lever 42 back and forth.

As described above, to cut off the roll staple 32, an operator has only to push the pressing member 13 into the staple feed passage 34. Also, since a great cut-off force can be obtained with a small pressing force, even a female operator is able to operate the pressing member to thereby cut the roll staple with ease.

Figure 22:
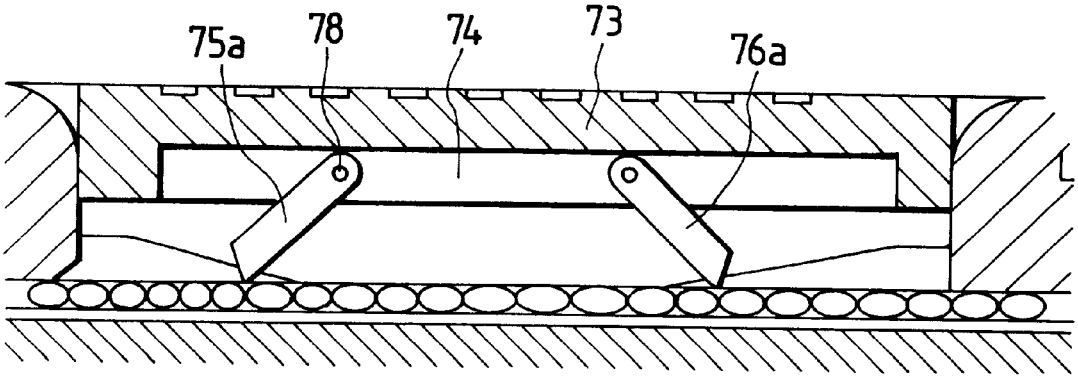
FIG. 22 is a section view of a staple cutting mechanism according to another embodiment of the invention.

By the way, the two cut-off pieces 75 and 76 may be arranged otherwise, provided that they fan out with respect to each other. For example, there can be employed such a structure as shown in FIG. 22. That is, in this structure, a recessed portion 74 is formed in the lower surface of the pressing member 73, two support shafts 78 are provided respectively in the front and rear portions of the recessed portion 74, and a pair of cut-off pieces 75*a* and 76*a* are respectively supported on the support shafts 78 in such a manner that they are respectively arranged along the longitudinal direction of the roll staple and can be freely rotated. The two cut-off pieces 75*a* and 76*a* are smaller in width than the roll staple 32 and are arranged in a mutually fan-out manner.

Figure 23:
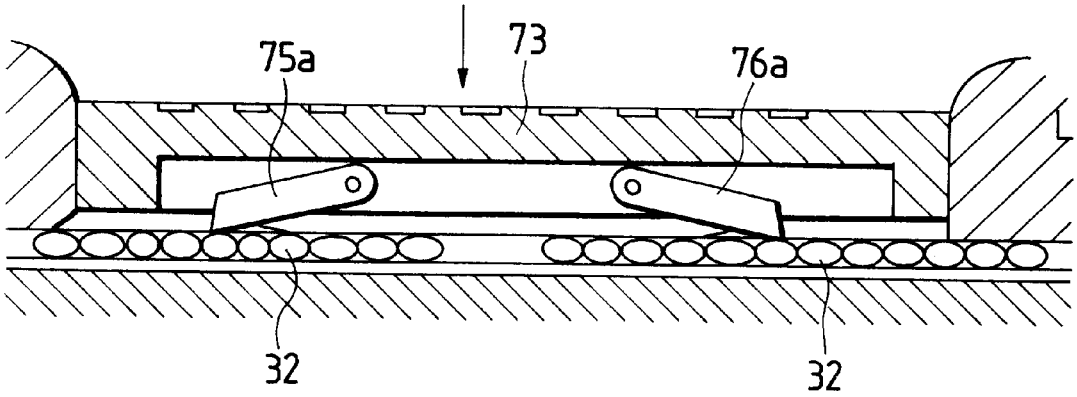
FIG. 23 is an explanatory view of the operation of the staple cutting mechanism shown in FIG. 22.

In this case as well, as shown in FIG. 23, if the pressing member 73 is pushed into the staple feed passage 34, then the roll staple 32 is pulled strongly by the two cut-off pieces 75*a* and 76*a*, with the result that the roll staple 32 can be cut off.

Also, according to the present embodiment, alternatively, the pressing member may be disposed on the lower side of the staple feed passage 34 and, when cutting off the roll staple, the pressing member may be pushed upward.

The present invention is not limited to the above-mentioned embodiments but various changes and modifications are possible without departing from the technical scope of the invention and, of course, such changes and modifications fall within the present invention.

As has been described heretofore, in a staple cartridge and a roll staple according to the invention, if the roll staple bound by the belt is loaded into the staple loading chamber and the belt is thereafter pulled, then the front portion of the roll staple is automatically pulled from the staple guide grooves into the staple guide table and, after then, the belt is peeled off from the roll staple, thereby completing the loading of the roll staple. Contrary to the conventional staple cartridge and roll staple, it does not take time and labor to insert the front portion of the roll staple into the staple guide grooves and feed the same forwardly with a finger. As a result, according to the invention, not only the operation to replenish the roll staple can be extremely simplified but also the handling efficiency of the present staple cartridge and roll staple can be enhanced greatly.

What is claimed is:

1. A staple cartridge for storing a roll staple formed by winding a sheet staple in a roll manner, the sheet staple of linear staples bonded together in parallel, said staple cartridge comprising:

a staple loading chamber receiving the roll staple;

a staple guide table located downwardly of said staple loading chamber;

a staple guide groove communicating from said staple loading chamber to said staple guide table located to feed the sheet staple from said staple loading chamber up to a position located in front of said staple guide table;

a lid openably and closably provided on said staple loading chamber to be able to replenish the roll staple;

an opening formed in the width-direction central portion of the bottom portion of said staple loading chamber to expose the upper surface of said staple guide table therethrough; and staple guide portions on the two left and right sides of said opening, respectively communicating with said staple guide table.

2. The roll staple to be loaded into the staple cartridge as set forth in claim 1, wherein said roll staple further includes a belt wound around said roll staple with one end of said belt bonded peelably to the outer peripheral side end portion of said roll staple, the other end of said belt is peelably bonded to the outer peripheral surface of said roll staple to bind said roll staple, and the width of said belt is smaller than the width of said opening formed in said staple loading chamber of said staple cartridge.

3. The roll staple as set forth in claim 2, wherein said roll staple further includes a tab portion on the outer peripheral end portion of said belt, and, a width of said tab portion is larger than the width of the interior portion of said staple loading chamber of said staple cartridge.

4. The roll staple cartridge according to claim 1, further comprising:

feeding means slidably disposed on the upper or lower surface side of said staple guide groove, wherein said feeding means has a feed pawl portion engageable with said roll staple within said staple guide groove, and a feed lever arranged so as to be exposed to the outside.

5. The roll staple cartridge according to claim 1, further comprising:

a staple cutting mechanism having a hold portion and a feed portion respectively formed on the upper or lower surface side of said staple guide groove such that said hold and feed portions are respectively engaged with said roll staple within said staple guide groove, wherein said feed portion is externaly operable so as to move back and forth with respect to said staple guide groove while said feed portion is superimposed on the exterior portion of said hold portion, and, with said feed portion and said hold portion respectively engaged with said roll staple, only said feed portion is moved forward to thereby be able to cut said roll staple from between said hold portion and said feed portion.

6. The roll staple cartridge according to claim 1, further comprising:

a staple cutting mechanism comprising a tape cutter which is disposed on the upper or lower surface side of said staple guide groove and is capable of cutting the connecting tape of said roll staple within said staple guide groove, wherein said tape cutter is externaly operable.

7. The roll staple cartridge according to claim 1, further comprising:

a staple cutting mechanism having a pressing member movable in a direction parpendicular to the roll staple within said staple guide groove, a pair of cut-off pieces respectively supported on said pressing member such that said cut-off pieces are respectively located along the longitudinal direction of said roll staple, are mutually arranged in a fan-out manner and can be rotated, wherein the leading ends of said two cut-off pieces are respectively butted against the surface of said roll staple within said staple feed passage to push said pressing member to forcibly spread out the gap between the respective leading ends of said two cut-off pieces, to cut off said roll staple.

* * * * *